United States Patent [19]

Ajland

[11] Patent Number: 4,631,517

[45] Date of Patent: Dec. 23, 1986

[54] FREQUENCY-MATCHED SIGNAL DEVICE FOR PERSONS WITH IMPAIRED HEARING

[76] Inventor: Kenth J. Ajland, Riddarvagen 74, S-184 02 Osterskar

[21] Appl. No.: 211,338

[22] Filed: Nov. 28, 1980

[30] Foreign Application Priority Data

Nov. 30, 1979 [SE] Sweden ..... 7909920

[51] Int. Cl.[4] ..... G08B 3/10

[52] U.S. Cl. ..... 340/326; 340/384 E

[58] Field of Search ..... 340/326, 384 E, 371; 179/1 N

[56] References Cited

U.S. PATENT DOCUMENTS 4,179,690 12/1979 Nicholls ..... 340/384 E

FOREIGN PATENT DOCUMENTS 1341842 12/1973 United Kingdom .

OTHER PUBLICATIONS

G. Swain—"Heathkit Model TD-1089 Electronic Chimes Unit", *Electronics*, Australia Feb. 1977, pp. 56-59.

R. E. Cousino "IC Doorbell Plays Your Song" *Radio Electronics* Sep. 1975, vol. 46, No. 9, pp. 33-35; 104 Reprinted by Inspec.

*Primary Examiner*—Donald J. Yusko

*Attorney, Agent, or Firm*—Lewis H. Eslinger

[57] ABSTRACT

A frequency-matched signal device for persons with impaired hearing, including an activating member (1,2,3), a signal generator (4) activated thereby for producing an electrical signal with a fundamental frequency which is within the range of audibility of a person having a normal sense of hearing, and an amplifier (10) having a loudspeaker (6) connected after it for amplifying the signal into an acoustic signal. A first device (P1) permits an optional setting of the fundamental frequency of the signal generator; a second device (P3, R1; 13,14,15) permits an optional setting of the signal generator so that it will deliver at least one additional electrical signal of at least one second frequency which is optionally adjustable and related to the fundamental frequency. The additional second signal or signals, respectively, is (are) amplified in the amplifier and an alternator (8) which is connected to the signal generator causes the electrical output signal of the signal generator to alternate between said frequencies at a predetermined slow rate.

8 Claims, 3 Drawing Figures

MONOSTABLE MULTIVIBRATOR
ALTERNATOR
AMPLIFIER
AUDIO AMP
SIGNAL GEN.
MODULATOR
+12 V
+15 V
16 V
470/16V
BD 140
BD 139
BD 263 A
BC 377
BC 327
T1
T2
T3
P1
P2
P3
P4
1M Linj.
500K Linj.
2M7
3 M3
1M5
0,68
3M3
1M
0,1
1K
22K
10K
33K
680 K
820 K
47K
100
0,015
2,2
1M
R1
22
15
4Ω
+12V

FREQUENCY-MATCHED SIGNAL DEVICE FOR PERSONS WITH IMPAIRED HEARING

The present invention refers generally to a signal device for persons with impaired hearing, by which is meant that the signal device delivers at least two acoustic signals which are located at frequencies to which the ears of the person with impaired hearing are sensitive.

Signal devices for persons with impaired hearing are well-known and include, for example, an electromagnetically operated door-bell (a so-called ding-dong), an optical system connected to door or telephone signals, a tele-loop which by magnetic coupling transmits radio and TV sounds to the hearing aid of the person with impaired hearing. The disadvantage of the electromagnetic bell is that the sound thereof which is amplified and located at quite a low level of frequencies will spread in apartment houses to and disturb neighbours who live not only in adjacent apartments but also in apartments at long distances from that of the person with impaired hearing.

The present invention aims at eliminating the disadvantage of the prior electromagnetic bell and instead utilizing a tone generator which delivers at least two acoustic signals the frequency of which may be adjusted to those frequencies to which the ears of the person with impaired hearing are most sensitive. These frequencies may be tuned in by the person with impaired hearing himself or the tuning may be made guided by the audiogram (a graph indicating the auditory perception of a person as a function of the frequency) of the person. Owing to the fact that the right and the left ear often do not have identical hearing impairments it is consequently suitable to have the signal device deliver two different tones. Thereby, the sound level of the signal device may be lowered so that adjacent neighbours need no longer suffer from the signal device. The two tones have to be emitted alternatingly by the signal device. Two alternating tones are more agreeable to the environment than a single signal sounding monotonously.

To provide for additional matching to the audiogram of the person with impaired hearing or to enable more persons with impaired hearing to use one and the same signal device, respectively, according to a modification of the invention, the signal device will emit several acoustic sequential signals different in frequency.

Other disadvantages of the prior signal devices are that a separate acoustic hearing aid must be installed. Furthermore, a separate optical hearing aid must be installed, and finally separate means must be provided for the connection of the door-bell to a tele-loop possibly installed in the apartment.

The present invention aims at locating the controls of each of the said three signal devices in one and the same unit. This unit has the shape of a box the size of which is not larger than a book.

Various embodiments of the invention will be described more closely hereinafter with reference to the attached drawings, in which FIG. 1 shows a block diagram of a first embodiment of the device according to the invention;

Figure 1:
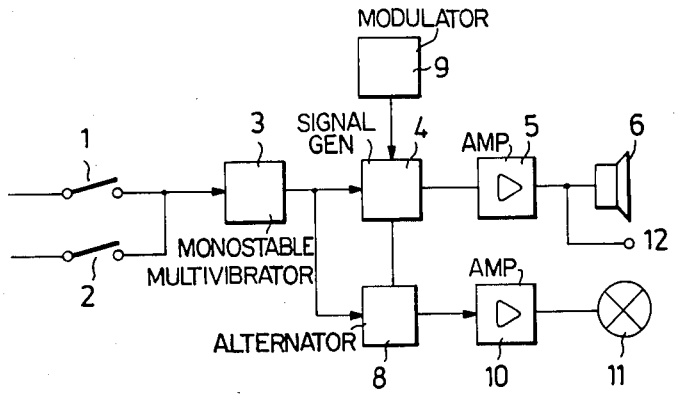

In the block diagram of FIG. 1, the reference numeral 1 designates a switch which closes at the actuation, for example, of the door-bell, while the reference numeral 2 designates another switch which closes, for example, when the telephone is ringing in the apartment of the person with impaired hearing. When either of the switches closes, a monostable multivibrator 3 is activated at the output of which an output signal is emitted the duration of which is about 5 seconds longer than the period during which the switch is closed. The output signal of the monostable multivibrator is passed to one input of a signal generator 4 at the output of which there is emitted an electrical signal of a certain optionally settable fundamental frequency. The electrical signal is amplified in an amplifier 5 which energizes a loudspeaker 6 which emits an acoustic signal of the fundamental frequency. The frequency depends on the voltage present at a first frequency-sensitive input of the signal generator 4. This frequency is adjustable by means described in more detail hereinafter. A second signal generator, also called an alternator 8, in the form of a second astable multivibrator, has its activating input connected to the output of the monostable multivibrator 3 and having its output connected to a second frequency-sensitive input of the first signal generator. When the second signal generator 8 is activated it delivers a voltage at its output which varies between a high and a low level, and the rate at which alternation occurs between these levels is adjustable at circuit elements of the second signal generator described in more detail below. The rate of alternation is slow, for example of the order of about ¼ Hz. When the second signal generator 8 emits the signal at a low level the signal generator 4 emits an electrical signal at its output at a frequency lower than the fundamental frequency. By means of a potentiometer the amplitude of the signal at a high level from the second signal generator may be adjusted within a range of frequencies which is independent of the set fundamental frequency but dependent on component values included in the circuits. In the preferred embodiment of the invention the signal generator 4 may be adjusted so that the fundamental tone is in the range of about 250 to 2500 Hz while the other signal is freely adjustable, for each setting of the first signal generator 4, within a frequency range extending down to three octaves below the fundamental tone.

To have the acoustic signals of the loudspeaker get a warmer tone it is suitable to control the output signal of the first signal generator 4 at a fixed, low frequency. This is effected by means of a modulator 9 in the form of a third astable multivibrator which emits a low amplitude signal with a frequency in the order of about 6 to 7 Hz.

So as also to get a blinking optical signal in actuating either of the switches 1, 2 the output of the second signal generator 8 is also connected to a driver amplifier 10 for a lamp 11 which will thus blink concurrently with the tone alternation. A connection 12 to the loudspeaker input may be joined to a tele-loop installed in the apartment of the person with impaired hearing. Possibly, an impedance matching operation must be undertaken before the connection 12 is joined to the tele-loop.

Figure 2:
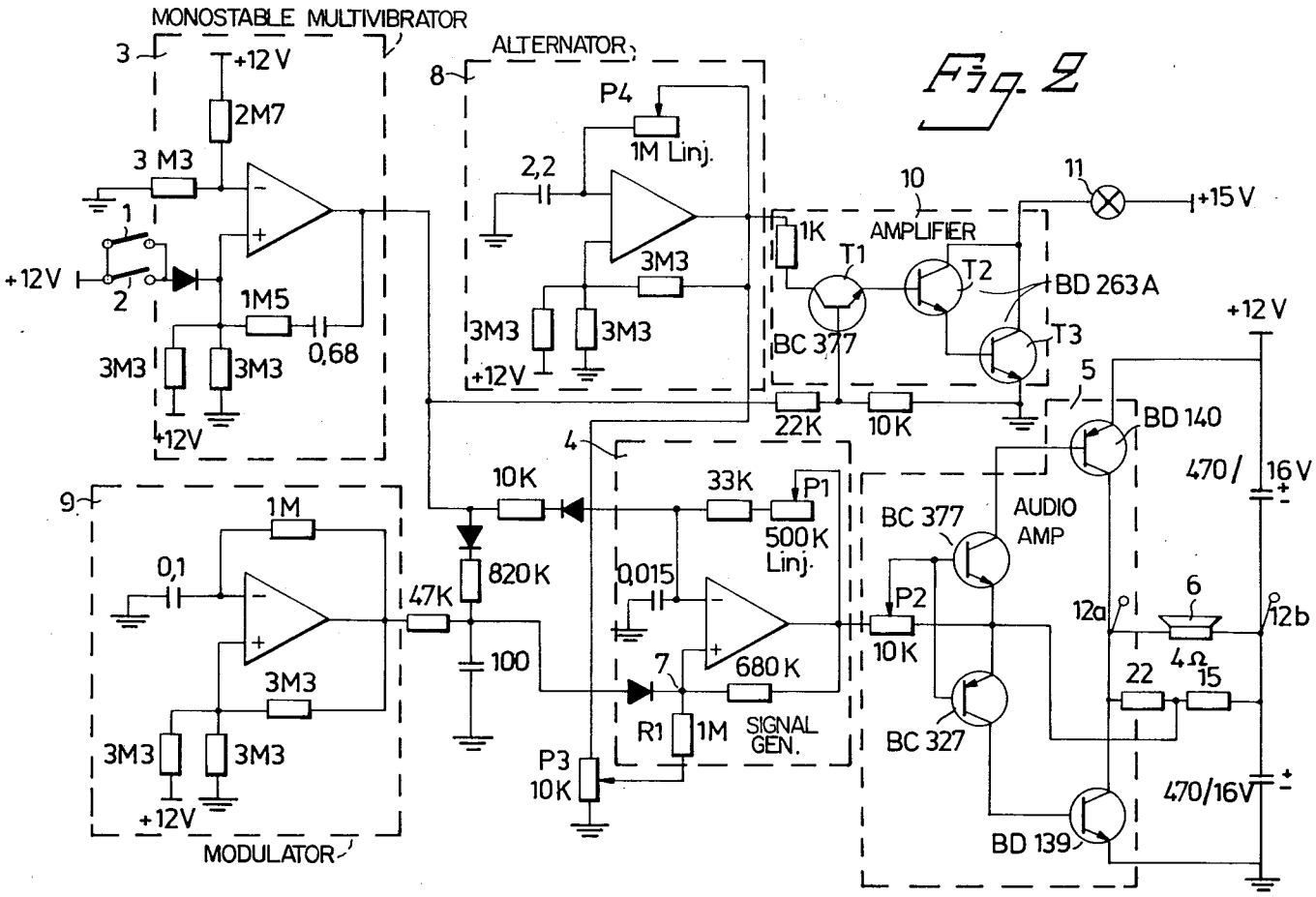
FIG. 2 shows a detailed circuit diagram of the device shown in FIG. 1.

In FIG. 2 the detailed circuit diagram of the block diagram shown in FIG. 1 is shown. Components in FIGS. 1 and 2 corresponding to each other have been indicated by the same reference numerals. The monostable multivibrator 3 is built in the conventional way around an operational amplifier. At the closing of either of the switches 1, 2 the multivibrator emits a signal at its output which passes to the non-inverting input of the first astable multivibrator 4 which is also built in the conventional way around a second operational amplifier. The fundamental frequency of the first astable multivibrator 4 is set by means of the potentiometer P1. The electrical signal at the fundamental frequency from the output of the first astable multivibrator is amplified in the amplifier 5 which operates according to the push-pull principle. The amplified signal feeds the loudspeaker 6. The volume may be adjusted by means of a potentiometer P2. The astable multivibrator 4 changes its frequency if the potential difference between its inverting and its non-inverting input is changed. According to the invention such a change in the differential voltage is effected by a voltage divider formed by resistors R1 and P3 and connected between the non-inverting input of the astable multivibrator 4 and the output of the astable multivibrator 8 which is also built in the conventional way around an operational amplifier. The frequency of the astable multivibrator 8 is adjustable by means of a potentiometer P4. As has been mentioned earlier the frequency of the multivibrator 8 is manifestly slow compared to the frequency of the multivibrator 4. When the potentiometer P3 is entirely disconnected the output signal of the multivibrator 4 is only one tone, namely the fundamental tone. In the fully turned-in position of the potentiometer P3 the output signal from the multivibrator 4 varies between two tones concurrently with the fundamental frequency of the multivibrator 8. One tone is the fundamental frequency and the other tone lies about three octaves lower than the former. Thus it is possible optionally to adjust the other tone about 0 to 3 octaves lower than the fundamental frequency set by the potentiometer P1. Said range of frequencies is dependent on the chosen component values of the voltage divider and of the resistors and capacitors included in the multivibrator 4. The modulator 9 is likewise composed of an astable multivibrator built in the conventional way which emits a low amplitude signal of the frequency 6 to 7 Hz. This signal passes to the non-inverting input of the operational amplifier in the multivibrator 4.

The output signal of the astable multivibrator 8 also passes to the driver amplifier 10 which includes a Darlington pair T2, T3 controlled by the transistor T1 and connected in the feeder line of the lamp 11. The feed voltage may, for example, consist of a non-stabilized voltage of +15 volts.

The connection 12 to a possible tele-loop consists of the terminals 12*a, b* of the loudspeaker 6.

All the four operational amplifiers are included in a single IC circuit of the type μA 324. The other component values are seen from the circuit diagram. The circuit is supplied. with a stabilized voltage of +12 volts which is obtained from a power unit not shown in greater detail. The capacitance values are stated in μF.

Figure 3:
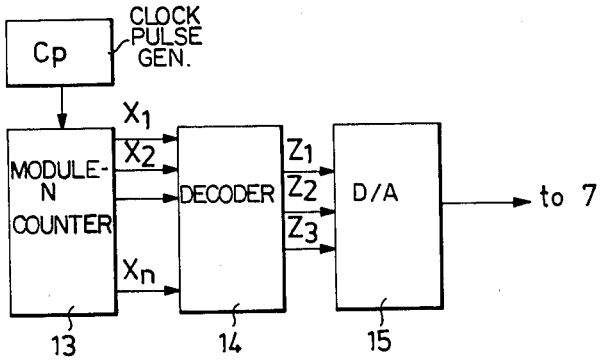
FIG. 3 shows a device which is intended to substitute the block of the device according to FIG. 1, to permit the production of three or more tones.

The signal device according to the invention can emit more than one tone in addition to the fundamental tone, for example two or more tones in addition to the latter. This may be realized by replacing the second astable multivibrator 8 and the voltage divider R1, P3 in FIG. 1 by the circuit shown in FIG. 3 which is of a conventional type and therefore is described in a general outline only. The circuit includes a clock pulse generator CP the clock pulses of which are counted in a modulo-n-counter 13 the counting outputs $x_1 \ldots x_n$ of which are connected to a decoder 14 which decodes a desired number of different tones which are obtained at the outputs $Z_1 \ldots Z_n$, three outputs $Z_1$–$Z_3$ being shown in the figure. These output signals $Z_1$–$Z_3$ are converted in a digital-to-analog converter 15 at the output of which three different sequential voltages are obtained. These voltages are applied to the non-inverting input of the multivibrator 4. Thus, in this case the loudspeaker 6 emits four different sequential tones, The embodiments of the invention as described above may be modified and varied in many different ways within the scope of the fundamental idea of the invention.

I claim:

1. A frequency-matched signal device for a person with impaired hearing, but whose right and left ears do not have identical hearing impairments, such that the person's hearing is sensitive to tones of two respective particular frequencies at substantially normal audio levels, comprising an acutator for selectively initiating operation of the device;

signal generating means activated by said actuator for generating alternating first and second audio tones; and output transducer means providing an acoustic signal in response to said audio tones; wherein said signal generating means includes an audio signal generator providing an electrical audio tone, first freely and continuously adjustable means for selectively setting the fundamental frequency of said electrical audio tone emitted thereby to the higher of the two particular frequencies to which the hearing of the person with impaired hearing is sensitive;

second freely and continuously adjustable means coupled to said audio signal generator for selectively setting the fundamental frequency of said second audio tone emitted thereby, without disturbing the setting effected by the first adjustable means, to the lower of said two particular frequencies, the second adjustable means being freely adjustable from the higher of the two particular frequencies downward over a range of three octaves; and an alternator coupled to the signal generator for causing the electrical output signal of the signal generator to alternate between said two particular frequencies at a predetermined slow rate.

2. A signal device according to claim 1, wherein said acutator includes a monostable multivibrator having an input connected to a switch, and an output coupled to said signal generating means, and generating an output signal, in response to actuatio of the switch, having a duration of about 5 seconds longer than the period of actuation of the switch.

3. A signal device according to claim 1, wherein said audio signal generator includes a first astable multivibrator having a control input; and said first freely adjustable means includes a variable resistor coupled to said control input to control the fundamental frequency of said electrical audio tone.

4. A signal device according to claim 1, wherein said first astable multivibrator also has a threshold control input, and said second freely adjustable means includes an adjustable voltage divider connected between said threshold control input and a point of reference potential, with said voltage divider including a second variable resistor.

5. A signal device according to claim 4, wherein said second variable resistor has a resistive element connected between an output of said alternator and said point of reference potential, and a slider coupled to said threshold control input of said first astable multivibrator.

6. A signal device according to claim 5, wherein said alternator includes a second astable multivibrator having an output and an input, and a third variable resistor coupled to said input for adjusting the rate of alternation, with said output being coupled to the resistive element of said second variable resistor.

7. A signal device according to claim 1, wherein said two particular frequencies to which the first and second freely adjustable means are set are determined from sensitivity maxima on an audiogram of the person with impaired hearing.

8. A method of providing signalling to alert a person with impaired hearing, but whose right and left ears do not have identical hearing impairments, such that the person's hearing is sensitive to tones of two particular frequencies and having substantially normal audio levels; and utilizing the frequency-matched signal device of claim 1, comprising:

developing an audiogram of the person's hearing;

determining, from the audiogram, maxima of auditory sensitivity for that person; and adjusting the first and second freely adjustable means in accordance with a higher-frequency and a lower-frequency maximum of sensitivity as determined from said audiogram to establish the fundamental frequencies of said first and second audio tones to correspond to such maxima.

* * * * *